US006334808B1

(12) United States Patent
Tanaka

(10) Patent No.: US 6,334,808 B1
(45) Date of Patent: Jan. 1, 2002

(54) METHOD FOR PROCESSING PERIPHERAL PORTION OF THIN PLATE AND APPARATUS THEREFOR

(75) Inventor: Koichi Tanaka, Nishi-shirakawa-gun (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/312,060

(22) Filed: May 17, 1999

(30) Foreign Application Priority Data

May 29, 1998 (JP) ..... 10-149934

(51) Int. Cl.[7] ..... B24B 1/00
(52) U.S. Cl. ..... 451/44; 451/42
(58) Field of Search ..... 451/41, 43, 44, 451/5, 8, 9, 42, 63

(56) References Cited

U.S. PATENT DOCUMENTS 5,445,554 A * 8/1995 Hosokawa ..... 451/41
5,609,514 A 3/1997 Yasunaga et al.
5,658,189 A * 8/1997 Kagamida ..... 451/44
5,727,990 A 3/1998 Hasegawa et al.
5,816,897 A * 10/1998 Raeder et al. ..... 451/44
5,944,584 A * 8/1999 Toyama ..... 451/43
6,066,031 A * 5/2000 Noguchi et al. ..... 451/44
6,093,087 A * 7/2000 Hakomori et al. ..... 451/44

FOREIGN PATENT DOCUMENTS

EP 0 826 459 A1 3/1998
GB 1108766 4/1968
WO WO 88/09242 12/1988

* cited by examiner

*Primary Examiner*—Derris H. Banks
(74) *Attorney, Agent, or Firm*—Oliff & Berridge, PLC

(57) ABSTRACT

A method for processing a peripheral portion of a thin plate, comprises the steps of; contacting the thin plate with a processing part of a tool, which has a round free end and projects to the thin plate in order to process the contacted peripheral portion of the thin plate, and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

26 Claims, 6 Drawing Sheets

METHOD FOR PROCESSING PERIPHERAL PORTION OF THIN PLATE AND APPARATUS THEREFOR

BACKGROUND OF THE INVENTION

1. Field of the Invention

The present invention relates to a method for processing a peripheral portion of a thin plate, such as a silicon wafer and an apparatus therefor.

2. Description of the Related Art

A shock (impact) load is applied to a peripheral portion of a silicon wafer when a lapping step or a double side polishing step is carried out in a process of manufacturing silicon wafers. A shock load is applied to a peripheral portion of a wafer in a process of manufacturing semiconductor elements because of a thermal stress caused by a heating and cooling treatment between room temperature and one thousand and several hundred degrees centigrade or because of a film forming treatment, such as an oxidation. Further, a shock load is applied to a peripheral portion of a wafer locally and frequently because a wafer is positioned, a wafer is transferred inside an apparatus, a wafer is transferred between one apparatus and another, a wafer is supported or the like by using a peripheral portion of the wafer in the process of manufacturing silicon wafers and in the process of manufacturing semiconductor elements.

When the shock load is applied to a peripheral portion of a wafer locally, the peripheral portion of the wafer is liable to be chipped off. Because the Si wafer which is a material for semiconductor elements is made of a silicon and is a single crystal, the wafer has a cleavage depending on a crystal orientation thereof and is brittle. When the wafer is chipped off, small fragments thereof fly. Because the small fragments adhere to the surface of the wafer, on which the semiconductor elements are formed, the characteristics of the semiconductor elements and the yield thereof are deteriorated.

The peripheral portion of the wafer has been chamfered in order to avoid or relieve these problems according to an earlier development.

Next, the typical three types of the chamfering apparatus will be explained below.

The first chamfering apparatus is a formed chamfering apparatus shown in FIG. 7. The chamfering apparatus 100 comprises a grinding wheel 101 (a so-called formed grinding wheel) having a groove of which shape is the same as that of a chamfered portion. The wafer W is held on the holding table 102 by using a vacuum chuck. In this chamfering apparatus 100, the grinding wheel 101 is pushed to the wafer W by applying a constant load thereto in order to process the peripheral portion of the wafer W. According to the chamfering apparatus 100, the shape of the chamfered portion of the wafer W is determined by the shape of the groove of the grinding wheel 101.

The second chamfering apparatus is a copy chamfering apparatus shown in FIG. 8. The chamfering apparatus 200 comprises a grinding wheel 201 having a groove 201*a* of which width is larger than the thickness of the wafer W. The wafer W is sandwiched by a pair of holding bodies 202 and 203 disposed at upper and lower positions of the wafer W to be sandwiched in order to hold the wafer W. In the chamfering apparatus 200, a copy model 204 is disposed on the same axis as the upper holding body 202. The copy model 204 and the upper holding body 202 rotate together and move in a vertical direction. A copy roller 205 is disposed on the same axis as the grinding wheel 201. The copy roller 205 and the grinding wheel 201 rotate independently of each other.

The process of chamfering the peripheral portion of the wafer is carried out by using the chamfering apparatus 200 as follows. That is, after the wafer W was sandwiched, the copy roller 205 moves in a direction of the copy model 204. The copy roller 205 and the copy model 204 roll in order to contact with each other. While the copy roller 205 moves, the grinding wheel 201 contacts the wafer W in order to start chamfering the peripheral portion of the wafer W. In the chamfering process, the peripheral portion of the wafer W is processed by rotating the wafer W by one rotation. The wafer W is moved upwardly and is rotated by one rotation in order to chamfer the upper surface of the peripheral portion of the wafer W. The wafer W is moved downwardly and is rotated by one rotation in order to chamfer the lower surface of the peripheral portion of the wafer W.

In the chamfering apparatus 200, because the diameter of the grinding wheel 201, which is measured on the basis of the bottom of the groove 201*a* is the same as that of the copy roller 205, the diameter of the wafer W is the same as that of the copy model 204. The upper surface of the peripheral portion of the wafer W is processed by the upper wall of the groove 201*a*. The lower surface of the peripheral portion of the wafer W is processed by the lower wall of the groove 201*a*. As a result, the shape of the upper part of the chamfered portion corresponds to that of the upper wall of the groove 201*a*. Similarly, the shape of the lower part of the chamfered portion corresponds to that of the lower wall of the groove 201*a*. Further, the width of the chamfered portion is determined by the positions in which the wafer W is disposed when the wafer W is moved upwardly and when the wafer W is moved downwardly.

The third chamfering apparatus is an NC (numerical control) chamfering apparatus which is not shown in the drawings. The chamfering apparatus carries out the control of the relative positions of the wafer and the grinding wheel not by using the copy roller and the copy model like the copy chamfering apparatus, but by the NC control. The process of chamfering the peripheral portion of the wafer is carried out similarly to the copy chamfering apparatus.

The function of the chamfered portion of the wafer is not only that the wafer is prevented from being chipped off. In particular, in case of a wafer for making an epitaxial wafer, the chamfered portion of the wafer prevents an extraordinary growth of an Si single crystal at the peripheral portion of the wafer. Further, the chamfered portion of the wafer drains liquid during a spin coat in a resisting step. It is decided by the cross-sectional shape of the chamfered portion of the wafer (hereinafter, referred to as "chamfer shape") and by the size thereof which function of the chamfered portion is superior to another. It is necessary to select the chamfer shape and the size of the chamfered portion suitably by considering which function is important. For example, the chamfer shape is a semicircular shape, a trapezoidal shape, a shape in which an end of a trapezoid is round or the like. There are various sizes of the chamfered portion.

However, in the three types of chamfering apparatus, because the chamfer shape is determined by the shape of the groove of the grinding wheel, it is necessary that one grinding wheel should be changed for another having a different groove from one grinding wheel when the shape of the chamfered portion is changed. Several types of grinding wheels must be prepared in order to change one grinding wheel for another. It is troublesome to change one grinding wheel for another. Further, there is a problem that a chamfering apparatus cannot be operated while one grinding wheel is changed for another.

SUMMARY OF THE INVENTION

The present invention was developed in view of these problems.

An object of the present invention is to provide a processing method for processing several types of chamfered portions or the like without changing one tool for another and a processing apparatus therefor.

That is, in accordance with one aspect of the present invention, the method for processing a peripheral portion of a thin plate, comprises the steps of; contacting the thin plate with a processing part of a tool, which has a round free end and projects to the thin plate in order to process the contacted peripheral portion of the thin plate, and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

In the specification, the word "process" means the process of the chamfered portion, that is, making the chamfered portion and polishing the chamfered portion, if other meanings of the word "process" are not given especially.

According to the method for processing the peripheral portion of the thin plate, because the step of contacting the thin plate with a processing part of a tool, which has a round free end and projects to the thin plate in order to process the contacted peripheral portion of the thin plate, and the step of moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate, are carried out, the peripheral portion of the thin plate can be processed by using each point of the processing part of the tool. As a result, the chamfered portions having various shapes can be properly made by one tool. When the tool for making the chamfered portion is changed for one for polishing the chamfered portion, the chamfered portions having various shapes can be polished. Because a load is dispersed into a whole processing part without applying it to a specific position of the tool, a life of the tool can be longer.

The moving step may be carried out by moving at least one selected from the tool and the thin plate further in a direction normal to the direction of the other, which is parallel to the main surface of the thin plate and to the direction of the other, which is normal to the main surface of the thin plate.

According to the method of processing the peripheral portion of the thin plate, even though the peripheral portion of the thin plate is composed of a linear form, the peripheral portion of the thin plate can be processed.

The processing part of the tool may comprise a flat portion of which upper and lower surfaces are parallel to each other.

A gentle slope part which is a boundary part between the chamfered portion and the main surface of the thin plate can be properly processed.

A thickness of the processing part may be two or more times larger than that of the thin plate. A radius of curvature of the round free end of the processing part may be larger than a half of a thickness of the flat portion of the processing part. The tool may have a cylindrical shape and the processing part attached to a circumferential portion of the tool has a ring shape.

In accordance with another aspect of the present invention, the method for processing a peripheral portion of a thin plate, comprises the steps of; contacting the thin plate with a processing part of a tool, which has a groove having a round bottom so as to surround the peripheral portion of the thin plate with the processing part from three different directions from one another, in order to process the contacted peripheral portion of the thin plate, and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

The opening width of the groove is not less than 1000 $\mu$m preferably when the thicknesses of the thin plates are from 500 $\mu$m to 900 $\mu$m. It is necessary that the opening width of the groove is not less than 1000 $\mu$m in order to process these thin plates by using one tool.

Because the step of contacting the thin plate with a processing part of a tool, which has a groove having a round bottom so as to surround the peripheral portion of the thin plate with the processing part from three different directions from one another, in order to process the contacted peripheral portion of the thin plate, and the step of moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate, are carried out, the peripheral portion of the thin plate can be processed by using each point of the processing part of the tool. As a result, the chamfered portions of the thin plate having a thickness smaller than the opening width can be properly made by one tool.

The moving step may be carried out by moving at least one selected from the tool and the thin plate further in a direction normal to the direction of the other, which is parallel to the main surface of the thin plate and to the direction of the other, which is normal to the main surface of the thin plate.

According to the method of processing the peripheral portion of the thin plate, even though the peripheral portion of the thin plate is composed of a linear form, the peripheral portion of the thin plate can be processed.

A depth of the groove is larger than a width of a chamfered portion of the thin plate.

A gentle slope part which is a boundary part between the chamfered portion and the main surface of the thin plate can be properly processed.

In accordance with another aspect of the present invention, the apparatus for processing a peripheral portion of a thin plate, comprises; a tool having a processing part which has a round free end and projects to the thin plate, a contacting device for contacting the thin plate with the processing part of the tool in order to process the contacted peripheral portion of the thin plate, and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

According to the apparatus for processing the peripheral portion of the thin plate, the peripheral portion of the thin plate can be processed by using each point of the processing part of the tool. As a result, the chamfered portions having various shapes can be properly made by one tool. When the tool for making the chamfered portion is changed for one for polishing the chamfered portion, the chamfered portions having various shapes can be polished. Because a load is dispersed into a whole processing part without applying it to a specific position of the tool, a life of the tool can be longer.

The moving device may move at least one selected from the tool and the thin plate further in a direction normal to the direction of the other, which is parallel to the main surface of the thin plate and to the direction of the other, which is normal to the main surface of the thin plate.

According to the apparatus for processing the peripheral portion of the thin plate, even though the peripheral portion of the thin plate is composed of a linear form, the peripheral portion of the thin plate can be processed.

The processing part of the tool may comprise a flat portion of which upper and lower surfaces are parallel to each other.

A gentle slope part which is a boundary part between the chamfered portion and the main surface of the thin plate can be properly processed.

A thickness of the processing part may be two or more times larger than that of the thin plate. A radius of curvature of the round free end of the processing part may be larger than a half of a thickness of the flat portion of the processing part. The tool may have a cylindrical shape and the processing part attached to a circumferential portion of the tool has a ring shape.

In accordance with another aspect of the present invention, the apparatus for processing a peripheral portion of a thin plate, comprises; a tool having a processing part which has a groove having a round bottom, a contacting device for contacting the thin plate with the processing part of the tool so as to surround the peripheral portion of the thin plate with the processing part from three different directions from one another, in order to process the contacted peripheral portion of the thin plate, and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

According to the apparatus for processing the peripheral portion of the thin plate, the peripheral portion of the thin plate can be processed by using each point of the processing part of the tool. As a result, the chamfered portions of the thin plate having a thickness smaller than the opening width can be properly made by one tool.

The moving device may move at least one selected from the tool and the thin plate further in a direction normal to the direction of the other, which is parallel to the main surface of the thin plate and to the direction of the other, which is normal to the main surface of the thin plate.

According to the apparatus for processing the peripheral portion of the thin plate, even though the peripheral portion of the thin plate is composed of a linear form, the peripheral portion of the thin plate can be processed.

A depth of the groove is larger than a width of a chamfered portion of the thin plate.

A gentle slope part which is a boundary part between the chamfered portion and the main surface of the thin plate can be properly processed.

According to the present invention, because the step of contacting the thin plate with a processing part of a tool, which has a round free end and projects to the thin plate in order to process the contacted peripheral portion of the thin plate, and the step of moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate, are carried out, the peripheral portion of the thin plate can be processed by using each point of the processing part of the tool. As a result, the chamfered portions having various shapes can be properly made by one tool. When the tool for making the chamfered portion is changed for one for polishing the chamfered portion, the chamfered portions having various shapes can be polished.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Figure 1:
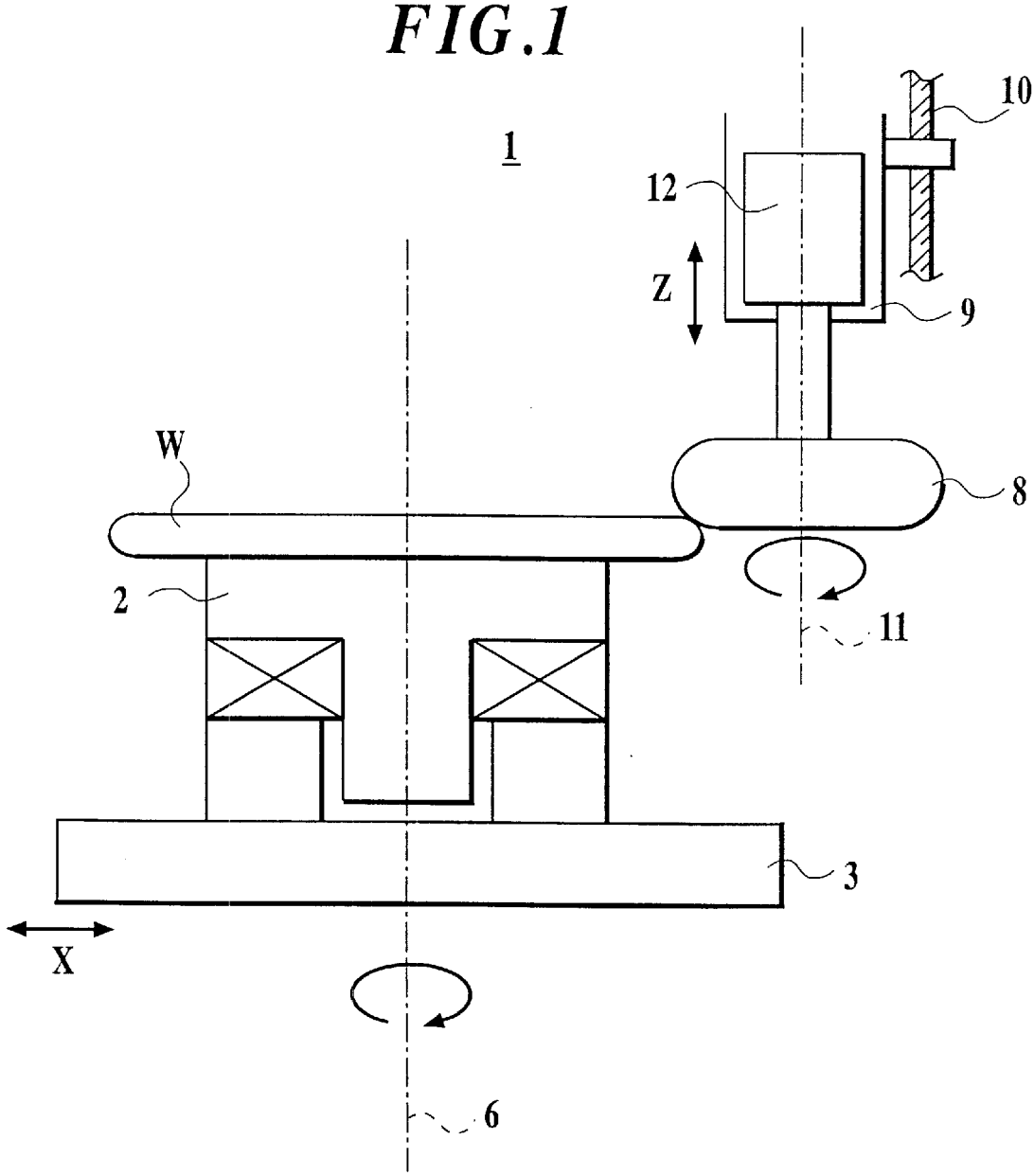
FIG. 1 is a view schematically showing an embodiment of the chamfering apparatus (a processing apparatus) according to the present invention.
Figure 2:
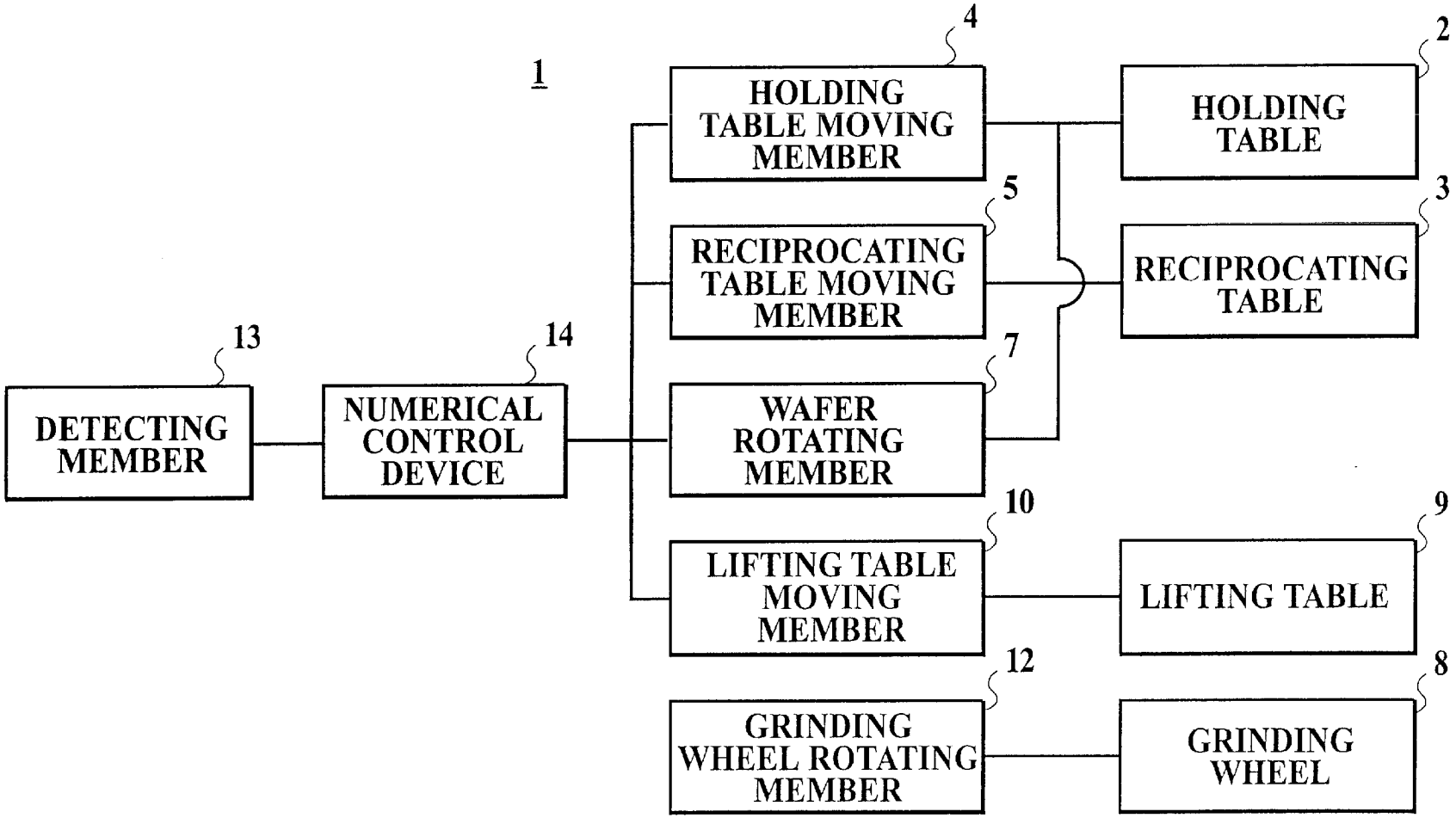
FIG. 2 is a block diagram showing the chamfering apparatus shown in FIG. 1.

FIG. 1 shows a chamfering apparatus (a processing apparatus) according to the embodiment of the present invention. FIG. 2 shows a block diagram thereof. The chamfering apparatus 1 comprises a holding table 2 for holding a wafer W by a vacuum chuck, a reciprocating table 3 for supporting the holding table 2 so as to move it in a direction normal to the surface of the sheet in the case of the apparatus shown in FIG. 1 (Y-direction), a holding table moving member 4 for moving the holding table 2 in the Y-direction on the reciprocating table 3, a reciprocating table moving member 5 for moving the reciprocating table 3 reciprocally in a direction of the arrow X (X-direction), a wafer rotating member 7 for rotating the holding table 2 and the wafer W on the first axis 6, a lifting table 9 for supporting a grinding wheel 8, a lifting table moving member 10 for moving the lifting table 9 in a direction of the arrow Z (Z-direction) and a grinding wheel rotating member 12 for rotating the grinding wheel 8 on the second axis 11. As shown in FIG. 2, the chamfering apparatus 1 comprises a detecting member 13 for detecting a position of the holding table 2 and the wafer W and a state that the holding table 2 and the wafer W rotate, and a numerical control device 14 for controlling the holding table moving member 4, the reciprocating table moving member 5, the wafer rotating member 7 and the lifting table moving member 10 on the basis of a signal outputted from the detecting member 13. A contacting device for contacting the wafer W with the grinding wheel 8 precisely and changing a contacting point between the wafer W and the grinding wheel 8, is composed of the holding table moving member 4, the reciprocating table moving member 5 and the lifting table moving member 10. A sliding member for sliding the wafer W and the grinding wheel 8 relatively to each other, is composed of the wafer rotating member 7 and the grinding wheel rotating member 12.

Figure 3:
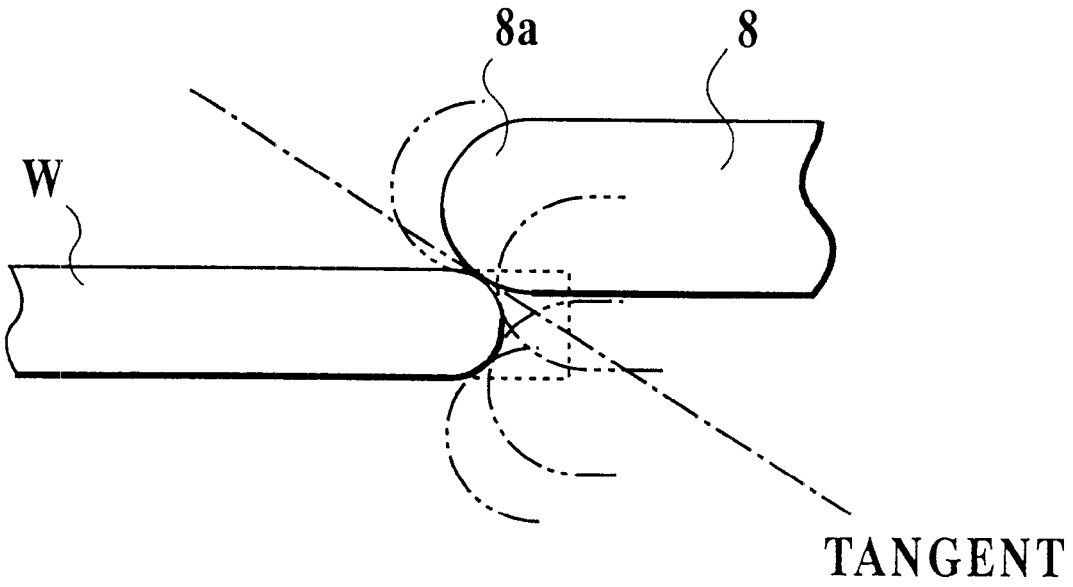
FIG. 3 is a view showing a state that the wafer set in the chamfering apparatus contacts the grinding wheel according to the first example.

Although the present invention is not limited to the thickness of the grinding wheel 8, the grinding wheel 8 is thicker than the wafer W as shown in FIG. 3. In consideration of practical use, such as the wear of the grinding wheel 8, a processing part 8*a* of the grinding wheel 8 is at least two or more times thicker than the wafer W, preferably. The shape of the grinding wheel 8 is a disk of which a peripheral portion projects in an arched form. In the concrete, the peripheral portion of the grinding wheel 8 projects in a semicircular form in consideration of practical use that the grinding wheel 8 is easily manufactured and the program for operating the reciprocating table 3 and the lifting table 9 is easily composed. The projection part of the grinding wheel 8 is the processing part 8*a* having a round free end.

Next, the operations of the chamfering apparatus 1 constructed as described above will be explained below.

The wafer W is held on the holding table 2. While the wafer W is rotated, the reciprocating table 3 is moved in order to contact the peripheral portion of the wafer W with the grinding wheel 8. At the same time, the grinding wheel 8 is rotated. When the peripheral portion of the wafer W starts to be chamfered, the reciprocating table 3 and the lifting table 9 are moved in order to move the grinding wheel 8 with respect to the wafer W in the X-direction and the Z-direction relatively. Thereby, the circumferential portion of the wafer W is chamfered.

When a linear part of the peripheral portion of the wafer W (an orientation flat portion) is chamfered, only the grinding wheel 8 is rotated. The grinding wheel 8 is moved with respect to the wafer W in the X-direction, the Y-direction and the Z-direction relatively.

According to the chamfering apparatus 1 constructed as described above, the grinding wheel 8 having the processing part 8*a* projecting in an arched form is used. Because the peripheral portion of the wafer W is processed by moving the grinding wheel 8 with respect to the wafer W in the X-direction, the Y-direction and the Z-direction relatively, the peripheral portion of the wafer W can be processed by using each point of the processing part 8*a* of the grinding wheel 8. As a result, the chamfered portions having various shapes can be properly made by one grinding wheel 8.

In order to confirm this effect, the chamfer shape was made by grinding the peripheral portion of the Si wafer obtained by slicing an ingot, which had a diameter of 201.0 mm and a thickness of 750 $\mu$m according to the present invention. As an example of a chamfered portion, the shape of the chamfered portion was composed of a circular arc form having a radius of curvature of 400 $\mu$m, a line having a slope of 22° with respect to the main surface of the wafer, and a circular arc having a radius of curvature of 300 $\mu$M. Further, they were connected smoothly. As a tool, a metal bonded diamond grinding wheel having an outer diameter of 80 mm, which had a projection on the peripheral portion thereof, of which cross section had a semicircular form having a radius of curvature of 3 mm, is used. In order to obtain the predetermined chamfer shape, the relative positions of the wafer and the grinding wheel were calculated geometrically on the basis of the diameter of the wafer as a target, the chamfer shape and the size of the grinding wheel. The amounts of movements of the reciprocating table, the lifting table and the holding table were determined in order to compose a program. The program was inputted into the numerical control device. In the grinding conditions, the rotating speed of the grinding wheel was set to 4000 rpm, that of the wafer was set to 30 rpm and the sliding speed of the grinding wheel was set to 1 mm/min. Water was used as a grinding fluid.

The peripheral portion of the wafer was processed under these conditions. After the process was finished, the chamfer shape was measured by the enlarged projection method. It was confirmed that the peripheral portion of the wafer was processed in the desired shape.

Figure 4:
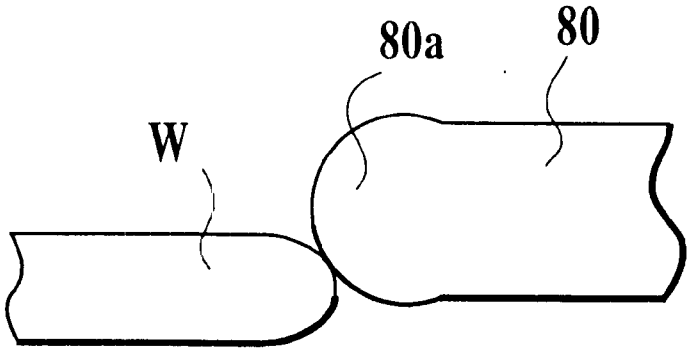
FIG. 4 is a view showing a state that the wafer contacts the grinding wheel according to the second example.
Figure 5:
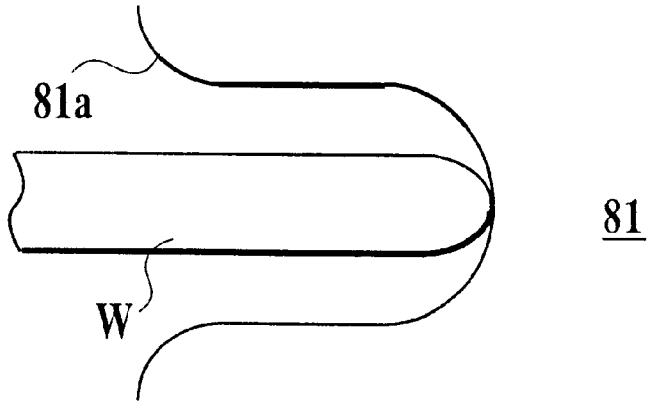
FIG. 5 is a view showing a state that the wafer contacts the grinding wheel according to the third example.

FIG. 4 shows the second example of a grinding wheel. The shape of the grinding wheel 80 is a disk of which peripheral portion projects. The projection part of the grinding wheel 80, that is, the processing part 80*a* has a flat portion of which upper and lower surfaces are parallel to each other, and a round free end having a radius of curvature which is larger than a half of the thickness of the flat portion. FIG. 5 shows the third example of a grinding wheel. The shape of the grinding wheel 81 is a disk of which peripheral portion has a groove therearound. The groove has a bottom recessed in an arched form and a curved shoulder portion. The groove of the grinding wheel 81 is a processing part 81*a*. The peripheral portion of the wafer W is chamfered in a state of surrounding the peripheral portion of the wafer W with the processing part 81*a* from three different directions from one another by using the grinding wheel 81. The depth of the groove is larger than the width of the chamfered portion of the wafer W.

Figure 6:
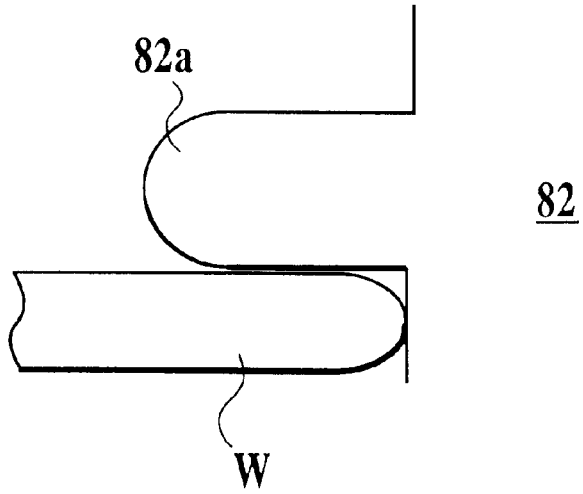
FIG. 6 is a view showing a state that the wafer contacts the grinding wheel according to the fourth example.
Figure 7:
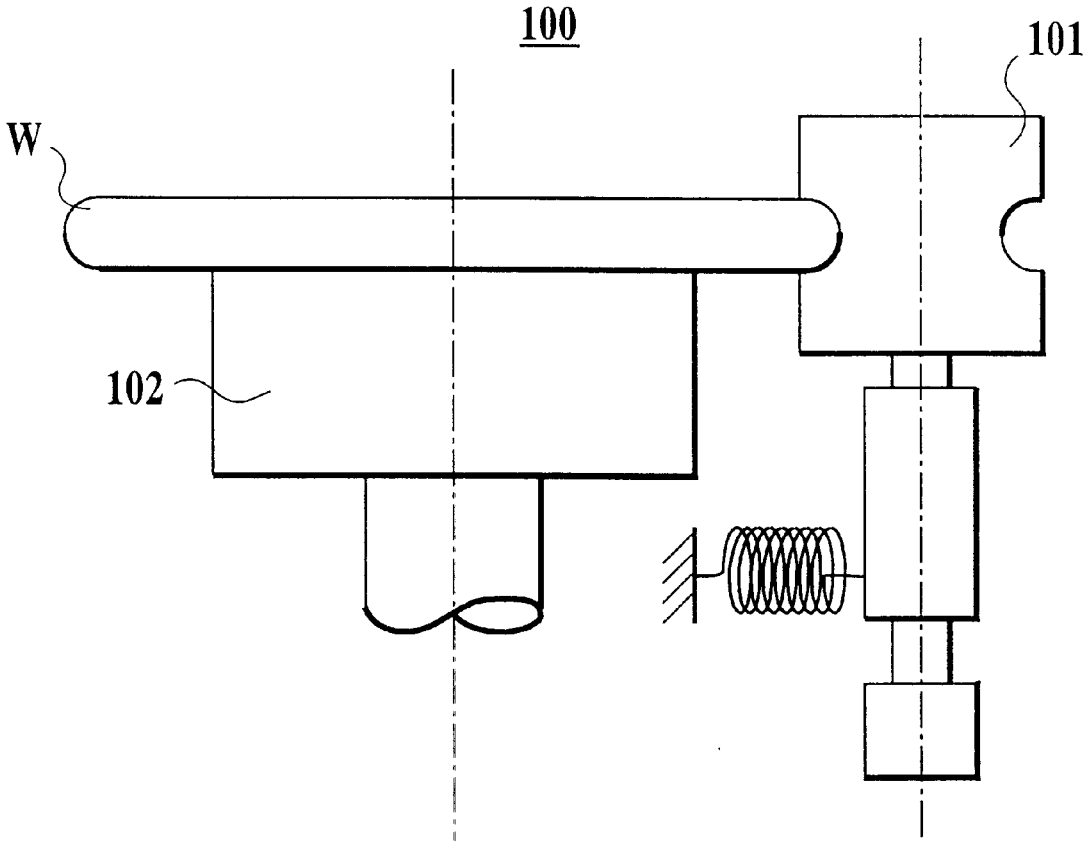
FIG. 7 is a view schematically showing a chamfering apparatus according to an earlier development.
Figure 8:
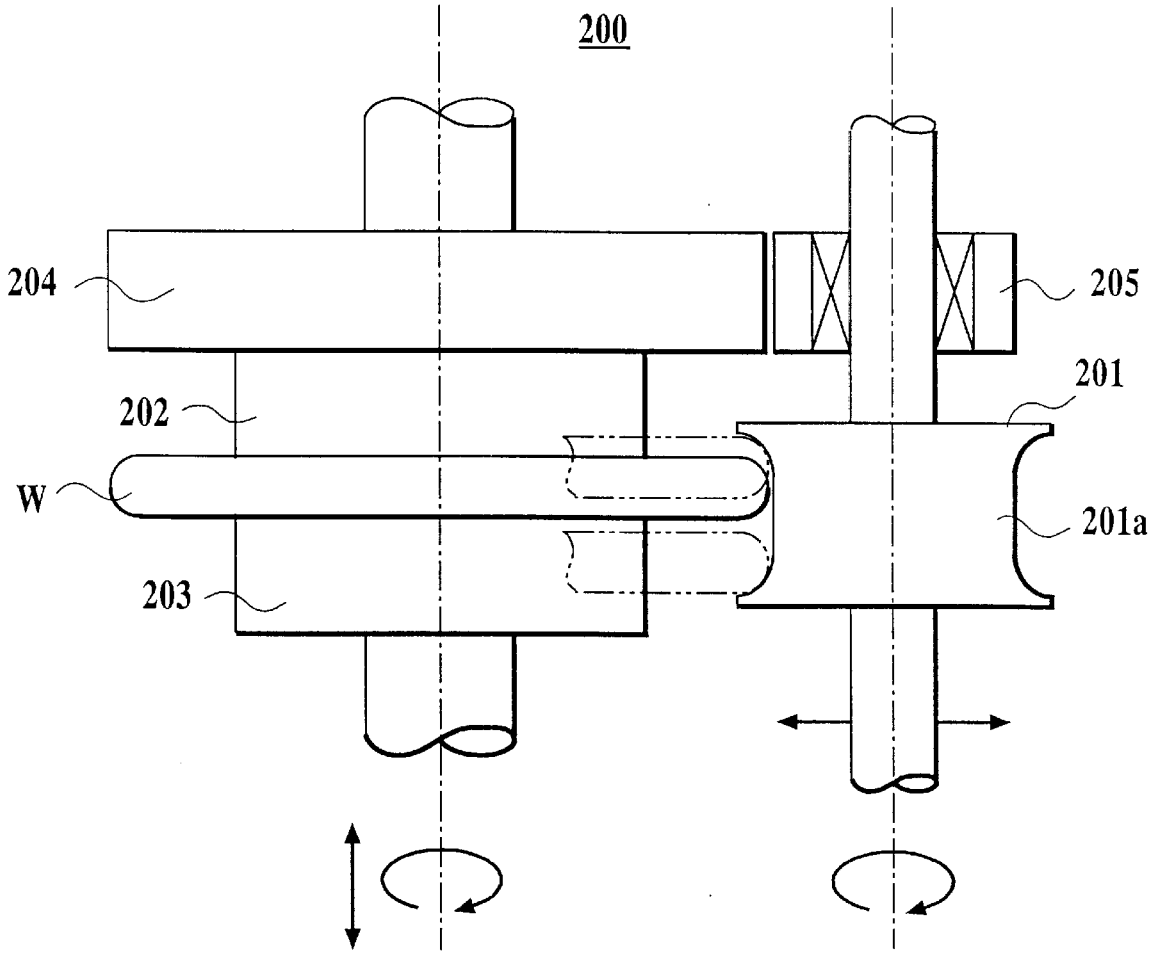
FIG. 8 is a view schematically showing another chamfering apparatus according to an earlier development.

FIG. 6 shows the fourth example of a grinding wheel. The body part of the grinding wheel 82 has a cylindrical shape. The grinding wheel 82 has a projection serving as a processing part 82*a* on the circumferential portion thereof. As shown in FIG. 6, the free end of the projection has an arched form. The projection has a ring shape. In this case, as shown in FIG. 6, the length of the processing part 82*a* is preferably larger than the width of the chamfered portion of the wafer W because the gentle slope part which is a boundary part between the chamfered portion and the main surface can be properly processed.

Although the present invention has been explained according to the embodiment, it should also be understood that the present invention is not limited to the embodiment and that various changes and modifications may be made to the invention without departing from the gist thereof.

For example, although it is explained that the peripheral portion of the wafer W is processed by using the grinding wheel, the present invention can be applied to the mirror-polishing of the chamfered portion, which is carried out by using a buff made of a foamed urethane or the like instead of the grinding wheel and by using a colloidal silica as an abrasive slurry. In this case, the wafer can be contacted not only with a specific position of a polishing pad but also with a large area thereof. Because irregularities transferred from the polishing pad to the wafer is averaged, a mirror-polished chamfered portion can be more smooth.

The notch portion is chamfered by using a grinding wheel having a small diameter in order to make a chamfer shape like the above embodiment.

Although it is explained that the Si wafer is chamfered by the tool, the present invention can be applied to any thin plate.

It is thought that when a simple cylindrical grinding wheel is used, the object of the present invention can be achieved by inclining the rotation axis of the grinding wheel. However, according to the present invention, a thin plate can be properly processed without controlling the rotation angle of the tool.

The entire disclosure of Japanese Patent Application No. Tokugan-Hei 10-149934 filed on May 29, 1998 including specification, claims drawings and summary are incorporated herein by reference in its entirety.

What is claimed is:

1. A method for processing a peripheral portion of a thin plate, comprising:

contacting the peripheral portion of the thin plate with a processing part of a tool, which has a round free end and projects to the thin plate, in order to process the contacted peripheral portion of the thin plate; and moving at least one selected from the tool and the thin plate in a direction of the other, which is parallel to a main surface of the thin plate while at least one selected from the tool and the thin plate is moved in a direction of the other, which is normal to the main surface of the thin plate, in order to change one contacting point between the peripheral portion of the thin plate and the processing part of the tool to another contacting point and to process the changed contacting point of the peripheral portion of the thin plate;

wherein a rotational axis of the tool is perpendicular to the main surface of the thin plate.

2. A method for processing a peripheral portion of a thin plate as claimed in claim 1, wherein the moving is carried out by moving at least one selected from the tool and the thin plate further in a direction normal to the direction of the other, which is parallel to the main surface of the thin plate and to the direction of the other, which is normal to the main surface of the thin plate.

3. A method for processing a peripheral portion of a thin plate as claimed in claim 1, wherein the processing part of the tool comprises a flat portion of which upper and lower surfaces are parallel to each other.

4. A method for processing a peripheral portion of a thin plate as claimed in claim 1, wherein a thickness of the processing part is two or more times larger than that of the thin plate.

5. A method for processing a peripheral portion of a thin plate as claimed in claim 3, wherein a radius of curvature of the round free end of the processing part is larger than a half of a thickness of the flat portion of the processing part.

6. A method for processing a peripheral portion of a thin plate as claimed in claim 1, wherein the tool has a cylindrical shape and the processing part attached to a circumferential portion of the tool has a ring shape.

7. A method for processing a peripheral portion of a thin plate, comprising:

contacting the peripheral portion of the thin plate with a processing part of a tool, which has a groove having a round bottom so as to surround the peripheral portion of the thin plate with the processing part from three different directions from one another, in order to process the contacted peripheral portion of the thin plate;

moving at least one selected from the tool and the thin plate in a direction of the other, which is parallel to a main surface of the thin plate while at least one selected from the tool and the thin plate is moved in a direction of the other, which is normal to the main surface of the thin plate, in order to change one contacting point between the peripheral portion of the thin plate and the processing part of the tool to another contacting point and to process the changed contacting point of the peripheral portion of the thin plate.

8. A method for processing a peripheral portion of a thin plate as claimed in claim 7, wherein the moving step is carried out by moving at least one selected from the tool and the thin plate further in a direction normal to the direction of the other, which is parallel to the main surface of the thin plate and to the direction of the other, which is normal to the main surface of the thin plate.

9. A method for processing a peripheral portion of a thin plate as claimed in claim 7, wherein a depth of the groove is larger than a width of a chamfered portion of the thin plate.

10. An apparatus for processing a peripheral portion of a thin plate, comprising:

a tool having a processing part which has a round free end and projects to the thin plate;

a contacting device for contacting the peripheral portion of the thin plate with the processing part of the tool in order to process the contacted peripheral portion of the thin plate; and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate;

wherein a rotational axis of the tool is perpendicular to the main surface of the thin plate.

11. An apparatus for processing a peripheral portion of a thin plate as claimed in claim 10, wherein the moving device moves at least one selected from the tool and the thin plate further in a direction normal to the direction of the other, which is parallel to the main surface of the thin plate and to the direction of the other, which is normal to the main surface of the thin plate.

12. An apparatus for processing a peripheral portion of a thin plate as claimed in claim 10, wherein the processing part of the tool comprises a flat portion of which upper and lower surfaces are parallel to each other.

13. An apparatus for processing a peripheral portion of a thin plate as claimed in claim 10, wherein a thickness of the processing part is two or more times larger than that of the thin plate.

14. An apparatus for processing a peripheral portion of a thin plate as claimed in claim 12, wherein a radius of curvature of the round free end of the processing part is larger than a half of a thickness of the flat portion of the processing part.

15. An apparatus for processing a peripheral portion of a thin plate as claimed in claim 10, wherein the tool has a cylindrical shape and the processing part attached to a circumferential portion of the tool has a ring shape.

16. An apparatus for processing a peripheral portion of a thin plate, comprising:

a tool having a processing part which has a groove having a round bottom:

a contacting device for contacting the thin plate with a processing part of a tool so as to surround the peripheral portion of the thin plate with the processing part from three different directions from one another, in order to process the contacted peripheral portion of the thin plate; and a moving device for moving at least one selected from the tool and the thin plate in a direction of the other, which is parallel to a main surface of the thin plate while at least one selected from the tool and the thin plate is moved in a direction of the other, which is normal to the main surface of the thin plate, in order to change one contacting point between the peripheral portion of the thin plate and the processing part of the tool to another contacting point and to process the changed contacting point of the peripheral portion of the thin plate.

17. An apparatus for processing a peripheral portion of a thin plate as claimed in claim 16, wherein the moving device moves at least one selected from the tool and the thin plate further in a direction normal to the direction of the other, which is parallel to the main surface of the thin plate and to the direction of the other, which is normal to the main surface of the thin plate.

18. An apparatus for processing a peripheral portion of a thin plate as claimed in claim 16, wherein a depth of the groove is larger than a width of a chamfered portion of the thin plate.

19. A method for processing a peripheral portion of a thin plate, comprising:

contacting the peripheral portion of the thin plate with a processing part of a tool in order to process the contacted peripheral portion of the thin plate, the processing part of the tool comprising a flat portion having upper and lower surfaces parallel to each other, and the processing part comprising a round free end and projecting to the thin plate; and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

20. A method for processing a peripheral portion of a thin plate, comprising:

contacting the peripheral portion of the thin plate with a processing part of a tool in order to process the contacted peripheral portion of the thin plate, the processing part of the tool comprising a flat portion having upper and lower surfaces parallel to each other, and the processing part comprising a round free end and projecting to the thin plate, a radius of curvature of the round free end is larger than a half of a thickness of the flat portion of the processing part; and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

21. A method for processing a peripheral portion of a thin plate, comprising:

contacting the peripheral portion of the thin plate with a processing part of a tool in order to process the contacted peripheral portion of the thin plate, the tool having a cylindrical shape and the processing part is attached to a circumferential portion of the tool and has a ring shape, the processing part having a round free end and projecting to the thin plate; and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

22. An apparatus for processing a peripheral portion of a thin plate, comprising:

a tool including a processing part having a round free end and projecting to the thin plate, the processing part comprising a flat portion having upper and lower surfaces parallel to each other;

a contacting device for contacting the peripheral portion of the thin plate with the processing part of the tool in order to process the contacted peripheral portion of the thin plate; and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

23. An apparatus for processing a peripheral portion of a thin plate, comprising:

a tool including a processing part having a round free end and projecting to the thin plate, the processing part having a thickness two or more times larger than that of the thin plate;

a contacting device for contacting the peripheral portion of the thin plate with the processing part of the tool in order to process the contacted peripheral portion of the thin plate; and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

24. An apparatus for processing a peripheral portion of a thin plate, comprising:

a tool including a processing part having a round free end and projecting to the thin plate, the processing part comprising a flat portion having upper and lower surfaces parallel to each other, and a radius of curvature of the round free end is larger than a half of a thickness of the flat portion of the processing part;

a contacting device for contacting the peripheral portion of the thin plate with the processing part of the tool in order to process the contacted peripheral portion of the thin plate; and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

25. An apparatus for processing a peripheral portion of a thin plate, comprising:

a tool including a processing part having a round free end and projecting to the thin plate, the tool having a cylindrical shape and the processing part is attached to a circumferential portion of the tool and has a ring shape;

a contacting device for contacting the peripheral portion of the thin plate with the processing part of the tool in order to process the contacted peripheral portion of the thin plate; and a moving device for moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate.

26. A method for processing a peripheral portion of a thin plate, comprising:

contacting the peripheral portion of the thin plate with a processing part of a tool in order to process the contacted peripheral portion of the thin plate, the processing part comprising a round free end and projecting to the thin plate, and the processing part having a thickness at least two times larger than that of the thin plate; and moving at least one selected from the tool and the thin plate in a direction of the other, which is parallel to a main surface of the thin plate and in a direction of the other, which is normal to the main surface of the thin plate, in order to change one contacting point between the peripheral portion of the thin plate and the processing part of the tool to another contacting point and to process the changed contacting point of the peripheral portion of the thin plate;

wherein a rotational axis of the tool is perpendicular to the main surface of the thin plate.

* * * * *